United States Patent [19]

Coles

[11] 3,979,873

[45] Sept. 14, 1976

[54] EXTENDING BOOM CONSTRUCTION

[75] Inventor: Manson Ivor Coles, Winnipeg, Canada

[73] Assignee: Mancole Company Limited, Winnipeg, Canada

[22] Filed: Nov. 22, 1974

[21] Appl. No.: 526,302

[30] Foreign Application Priority Data

Nov. 26, 1973 United Kingdom ..... 54718/73

[52] U.S. Cl. ..... 52/632; 52/118

[51] Int. Cl.[2] ..... E04H 12/10

[58] Field of Search ..... 52/115, 116, 117, 118, 52/120, 121, 632; 182/141, 63; 212/55

[56] References Cited

UNITED STATES PATENTS

| | | | |
|---|---|---|---|
| 1,319,943 | 10/1919 | Bessolo | 52/121 X |
| 2,339,327 | 1/1944 | Fox | 52/121 X |
| 2,684,159 | 7/1954 | Oldenkamp | 212/55 |
| 2,920,725 | 1/1960 | Emmons | 52/118 |
| 2,942,700 | 6/1960 | Parmenter et al. | 52/121 |
| 2,948,363 | 8/1960 | Hopfeld | 182/141 |
| 3,000,473 | 9/1961 | Reynolds | 52/121 |
| 3,328,921 | 7/1967 | Keslin | 52/121 |
| 3,494,593 | 2/1970 | Blagg | 52/121 X |
| 3,841,494 | 10/1974 | Chalupsky et al. | 212/55 |
| 3,874,136 | 4/1975 | Michel | 52/118 X |

FOREIGN PATENTS OR APPLICATIONS

| | | | |
|---|---|---|---|
| 201,811 | 1/1959 | Austria | 52/115 |

*Primary Examiner*—Ernest R. Purser
*Assistant Examiner*—Leslie Brown
*Attorney, Agent, or Firm*—Stanley G. Ade

[57] ABSTRACT

A plurality of telescopic triangular cross sectioned booms slide within one another so that they can be extended and retracted and they are adapted to support conduits for pumping concrete or other material from one location to another. Angulated flanged corner constructions support the booms for sliding movement one with the other and in one embodiment, wheeled trolleys or bogeys are secured to the corners to reduce the frictional load between adjacent boom sections.

10 Claims, 11 Drawing Figures

EXTENDING BOOM CONSTRUCTION

BACKGROUND OF THE INVENTION

This invention relates to new and useful improvements in extending boom constructions, particularly constructions designed for use in extending towers or the like used for pumping concrete.

When pumping concrete, it is normal to add lengths of conduit from the pump which extends to the position in the building or structure where the concrete is required. As the building progresses, either the conduits have to be extended in length or the pump has to be moved closer as it will be appreciated that frictional losses in long conduits are considerable. If the conduit was relatively straight and smooth, then frictional losses would be lessened, but normally bends and angles have to be incorporated in order to position the discharge end of the conduit in the desired position.

SUMMARY OF THE INVENTION

The present invention overcomes the disadvantages inherent with conventional systems by providing a telescopic pipe boom or tower which can be positioned in any desired angle from the vertical to the horizontal. This tower can be extended as required and lengths of conduit can be added and supported within the tower so that bends and angles are kept to a minimum. It is extremely easy to add or subtract lengths of conduit and to extend or retract a tower or boom to the extent necessary.

The principal object and essence of the invention is to provide an extending tower or boom which is preferably three-sided in configuration and which is provided with novel sliding joints at the corner angles of the structure.

Another object of the invention is to provide a device of the character herewithin described in which the telescopic tower is self supporting within limits regardless of the angle of inclination.

Another object of the invention is to provide a device of the character herewithin described in which the boom sections can slide frictionally on one another or, alternatively, wheeled bogeys can be provided to reduce friction.

A further object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

In the drawings like characters of reference indicate corresponding parts in the different figures.

DETAILED DESCRIPTION

Figure 2:
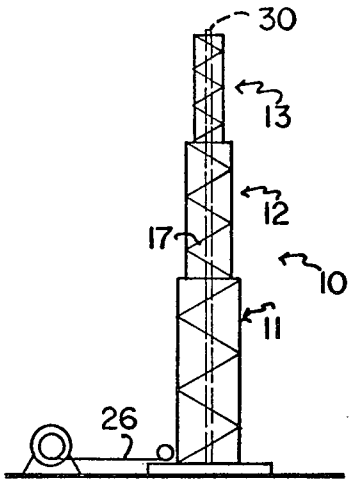
FIG. 2 is a schematic side elevation in a scale similar to FIG. 1 showing the tower extending vertically.
Figure 1:
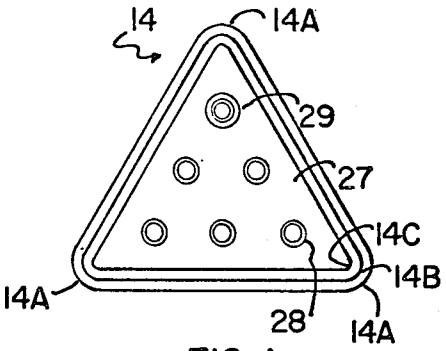
FIG. 1 is a schematic top plan view of the boom or tower reduced in size from the other drawings.

Proceeding therefore to describe the invention in detail, reference should first be made to FIGS. 1 and 2 in which 10 illustrates generally the tower or boom. In the views, the tower is shown extending vertically, but it should be appreciated that this tower can be anchored upon a base structure (not illustrated) and inclined from the vertical by hydraulic means and maintained in this position depending upon the requirements of the particular construction with which the tower is used.

In the present embodiment, the tower or boom 10 consists of three sections namely a base section generally designated 11, an intermediate section generally designated 12, and an upper section generally designated 13, but it will of course be appreciated that two, three, four or more sections can be utilized depending upon design parameters.

Each of the sections are telescopically engaged serially within the other and it will be observed from FIG. 1 that the desired configuration of each section is hollow triangular when viewed in plan. However, this configuration can be formed with three, four or more sides depending upon design.

Figure 4:
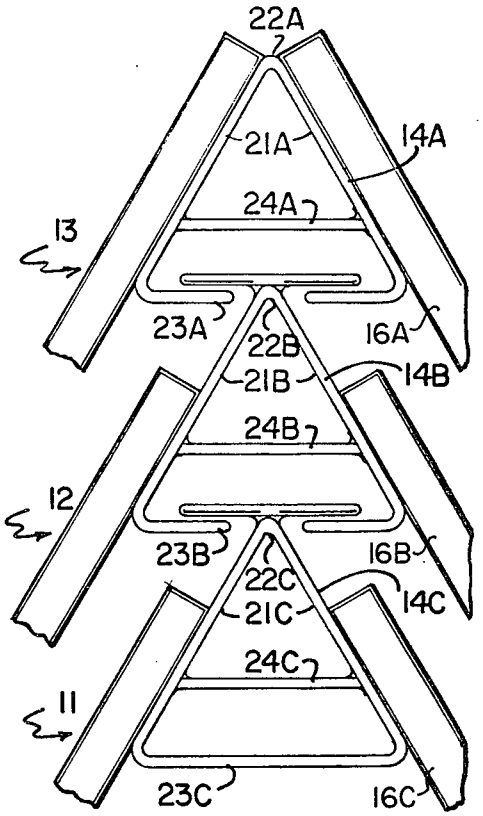
FIG. 4 is an enlarged partially schematic view of one corner of the tower showing an alternative sliding joint construction.
Figure 3:
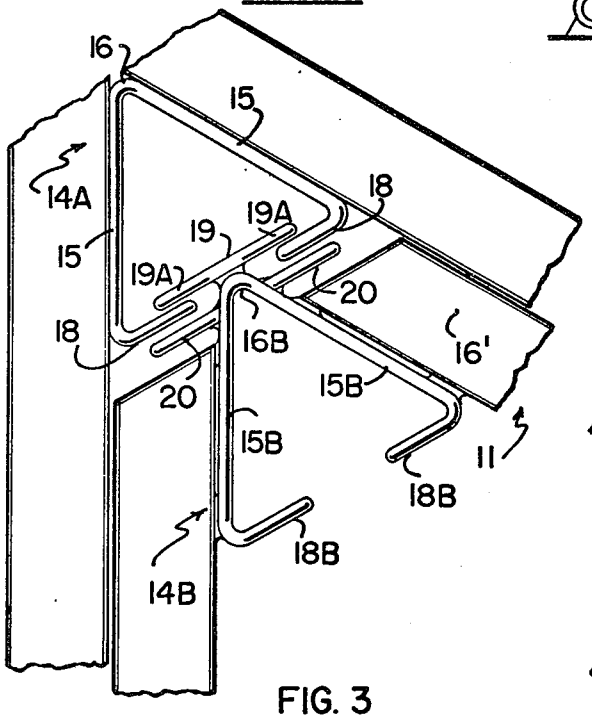
FIG. 3 is an enlarged fragmentary top plan view of one corner of two of the sections showing one embodiment of the sliding joint assembly.
Figure 9:
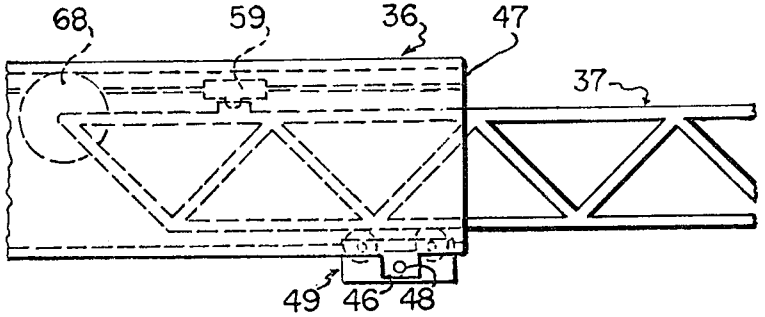
FIG. 9 is a side elevation of FIG. 6.
Figure 6:
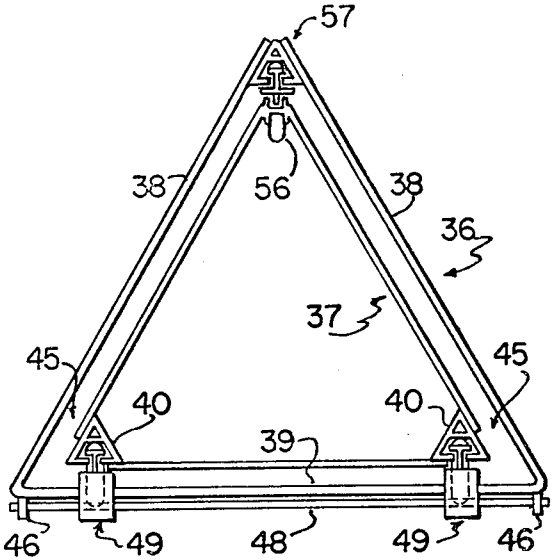
FIG. 6 is an end view of two boom sections including the preferred embodiment.

At each corner generally designated 14 of the tower or boom assembly, sliding joint assemblies are provided between adjacent boom section, embodiments of which are shown in FIGS. 3, 4 and 6 respectively.

Dealing first with FIG. 3, an enlarged plan view of the corner junction between two adjacent sections is illustrated.

The corner construction generally designated 14A of the outermost section includes a pair of longitudinally extending plate members 15 terminating at the outer apex 16 and the angular relationship between the plates 15 is similar to the sides 16' of the outermost section 11.

The sides 16' extend between adjacent corners 14A and are of a cross girder construction as illustrated schematically by reference character 17 in FIG. 2.

The inner ends 18 of the plates 15 angulate inwardly towards one another and terminate in spaced apart relationship opposite the apex 16 as clearly illustrated in FIG. 3.

The corner construction 14B of the next or intermediate section 12 also consists of a pair of longitudinally extending plates 15B terminating in a common apex 16B with the inner ends 18B being angulated inwardly towards one another and terminating in spaced apart relationship as clearly shown.

However, an elongated flat plate 19 is welded to the apex 16B and forms flanges 19A on each side of the apex which engage behind the inturned ends or flanges 18 of the outermost plates 15.

The plates 15, 15B, etc., and the inner ends 18, 18B, etc., form longitudinally extending substantially triangular supports or corner constructions at each corner of the sections.

Brace flanges 20 ae welded on each side of the apex 16B spaced and parallel to the flanges 19A and engage on the outer surfaces of the portions 18 thus making a sliding junction between the two corner portions 14A and 14B as clearly illustrated in FIG. 3.

A similar construction exists between the innermost sections 13 and the intermediate sections 12, but this is not illustrated in this particular embodiment.

FIG. 4 shows a further embodiment in which all three sections are shown in engagement one with the other by one corner thereof, but it will be appreciated that the portions are shown expanded or spaced apart with relation to one another, for clarity.

The corner portion 14A of the outermost section 13 is formed from a pair of vertically extending plates 21A which are similar to plates 15 hereinbefore described and which terminate in an outer apex 22A.

The inner sides are turned inwardly to form flanges 23A which terminate in spaced apart relationship similar to the flanges 18 hereinbefore described and a brace 24 spans the plates 21A internally and intermediate the ends thereof as clearly illustrated.

The side structure 16′ is similar to that hereinbefore described, it being understood that this side structure extends between adjacent corners of the outermost section 13.

The intermediate section 12 is also provided with a corner construction 14B which is similar in construction to the corner construction 14A hereinbefore described so tht similar reference characters have been given the portions or parts with the suffix "B" added thereto.

However, an additional vertically extending plate or flange 25 is welded across the apex 22B parallel to the flanges 23B and this flange 25 engages within the inturned flanges 23A of the outer corner 14A as clearly shown, thus giving a sliding connection therebetween. This is similar to the flanges 19A described in FIG. 3.

The corner construction 14C of the innermost section 11 is similar in construction so that similar parts have been given the same reference characters except that they are distinguished by the suffix "C". However, the innermost flanges 23C extend clear across and form the complete triangular corner structure in this innermost section 11.

This provides sliding junctions at each corner of the structure thus enabling the sections to be extended or retracted bv conventional cable and winch means shown generally in FIG. 2 by reference character 26. As the cable connections to the various sections are conventional, they have been not shown in detail in this application.

The innermost section defines an open triangular area 27 within which may be stored lengths of conduit 28 adapted to be connected together and which may readily be positioned one upon the other as the tower or boom is extended.

It is preferable that two of the conduits be telescopic as illustrated schematically in FIG. 1 by reference character 29 with the remaining sections of conduit being attachable by conventional means to one end of this telescopic combination 29.

Figure 5:
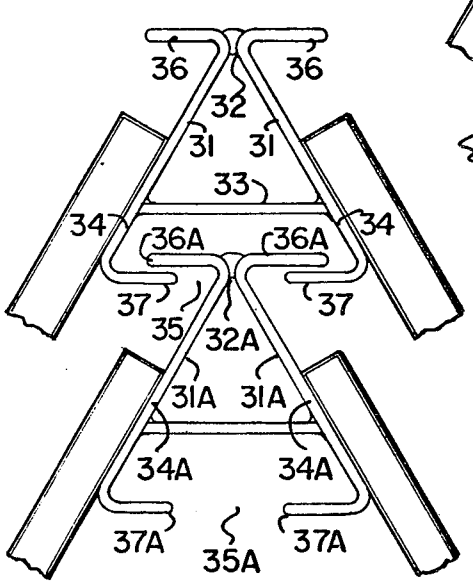
FIG. 5 is a fragmentary view showing an alternative method of construction for the embodiment shown in FIG. 4.

FIG. 5 shows a further method of construction of the corner assembly designated 14D. In this embodiment, the outer section is formed from a pair of similar Z sections 31 welded together at the junction 32 and having a web 33 welded across the side members 34 internally to maintain the gap 35 constant by preventing the sides from spreading. The next assembly or section is similar in construction and has been given similar numbers with an A suffix. These Z shaped sections 31 are symmetrical and reversible thus making it easy to fabricate, only one shape and size being required. Out-turned flange portions 36, 36A are formed similar to portions 19A, etc., and in-turned flanges 37 are forced similar to portion 23, 23A, etc., hereinbefore described.

This forms an extremely rigid boom or tower structure which is easily moved inwardly and outwardly as desired thus enabling the discharge end 30 of the conduit to be directed where desired for the placing of concrete from a concrete pump (not illustrated).

Preferred embodiment is illustrated in FIGS. 6 to 11 and is particularly adapted for use with heavy duty boom sections such as those used in the pumping of concrete or the like.

The boom sections are similar in construction and in these particular views, an outer boom collectively designated 36 is shown with an inner boom collectively designated 37 slidable therewithin.

The outer boom 36 is provided with sides 38 and a base side 39 thus providing a triangular cross section which is hollow. However, any desired shape can of course be utilized.

Figure 8:
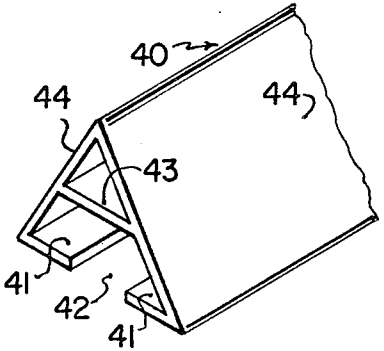
FIG. 8 is an enlarged fragmentary isometric view of one of the corner sections per se.

Incorporated within the construction of the inner boom 37 is a pair of longitudinally extending corner portions collectively designated 40 which are similar in construction to the corner portions hereinbefore described and may take the form illustrated in FIG. 4 by reference character 14A as clearly shown in FIG. 8.

In-turned flanges 41 define a longitudinally extending slot or gap 42 and a brace plate 43 spans the side plates 44 for rigidity and also to act as a track as will hereinafter be described.

In the present embodiment, these are situated at the two base corners of the inner boom section 37 identified by reference characters 45.

A pair of lugs 46 extend downwardly from the outer end 47 of the outer section 36 and a rod or shaft 48 engages through these lugs and extends across the base 39 of the outer boom section.

Figure 7:
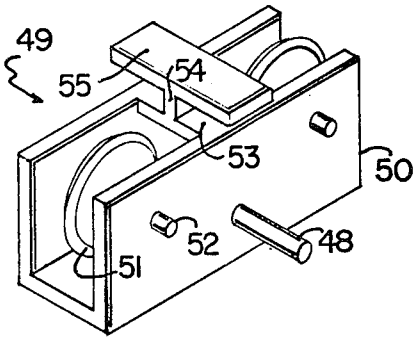
FIG. 7 is an isometric view of one of the wheeled trolleys.

Trolleys collectively designated 49 freely engage these rods and in this regard, reference should be made to FIG. 7.

Each of the trolleys includes a U-shaped frame or housing 50 having a pair of wheels 51 journalled for rotation therebetween, upon spindles 52 and these two wheels are in alignment with the other as clearly illustrated.

A cross member 53 spans the upper edges of the U-shaped casing 50 and a small vertical web 54 extends upwardly from the portion 53.

The transverse slider plate 55 is secured to the upper end of the web and extends transversely across the edges of the housing or casing 50, but spaced therefrom as clearly illustrated.

This slider plate 55 is engaged within the corner portion 40 and engages the inner surfaces of the in-turned flanges 41 thereof with the web 54 freely engaging the longitudinal slot 42.

The wheels 51 also engage through the slot 42 and run on the underside of the brace portion or track 43 with the portion 55 preventing disengagement of the trolley from the corner portion 40.

Two such trolleys are provided in FIG. 6 thus supporting the inner boom section 37 for extension and retraction relative to the outer boom section 36 and reducing the frictional engagement therebetween. The mounting of the trolleys 50 upon the shaft 48 allows both of the trolleys to align freely with relation to the corner portions 40 as they run therein.

Means are provided to give support to the apical corner 56 of the inner section 37 by supporting same within the apical corner 57 of the outer section 36. This is of particular concern when the inner section is extended fully and this support assists in the cantilever support of the inner section relative to the outer section and prevents same from jamming.

Figure 10:
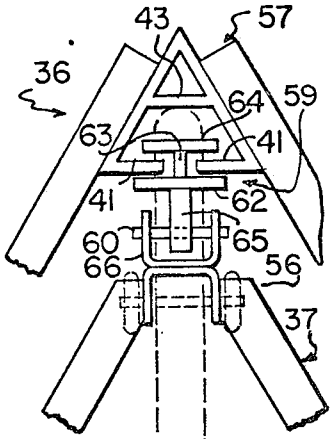
FIG. 10 is an enlarged fragmentary view showing the apical corner engagement of one section with the other.
Figure 11:
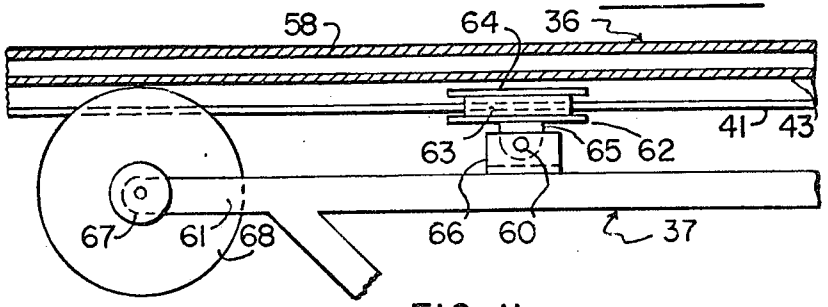
FIG. 11 is a fragmentary partially sectioned view of FIG. 9 enlarged with respect to FIG. 9.

FIG. 10 shows an end view of the two apical corners and FIG. 11 shows a fragmentary partially sectioned side elevation thereof.

A corner portion 58 similar to corner portions 40, is incorporated within the apical corner 57 of the outer section 36 and is similar in construction to the portion 40 hereinbefore described.

A slider collectively designated 59 is pivotted upon pin 60 to the apical corner 56 of the inner boom section 37 inboard of the inner end 61 thereof and this slider includes a horizontal lower plate 62, a web 63 and a horizontal upper plate 64. The web 63 engages the slot 42 of the corner portion 58 with the lower plate 62 engaging under the in-turned flanges 41 and the upper plate 64 engaging on the upper sides of these in-turned flanges 41. In the drawings, the spacing has been exaggerated for clarity.

As the inner section approaches its fully extended position, means are required to prevent the slider from jamming, it being understood that the slider is pivotted upon pin 60 by means of lugs 65 and 66 as shown in FIG. 11.

A pair of lugs 67 are formed on the inner end of the apical corner 56 of the inner section spaced rearwardly from the pivot pin 60 and these lugs support a wheel 68 for rotation therebetween and in a vertical plane as clearly illustrated in FIG. 11. The thickness of this wheel is sufficient to enable same to pass freely through the slot 42 and engage upon the underside of the track 43 thus supporting the inner section in a cantilever fashion in conjunction with the lower trolleys, when the inner boom section 37 is extended relative to the outer boom section 36.

The remaining construction of the boom sections is similar to that hereinbefore described and where applicable, similar reference characters have been provided.

Conventional means are provided (not illustrated) to extend and retract the boom section 37 relative to the boom section 36 and in this regard, the extensions of shaft 48 beyond lugs 46, may be utilized for cable attachments.

However, as the method of extension and retraction does not form part of the present invention, it is not believed necessary to describe same further.

Since various modifications can be made in my invention as hereinbefore described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A telescopic tower construction comprising in combination a plurality of elongated sections telescopically engaged serially within one another, said sections including an outer section and at least one inner section slidably engaged within said outer section and adapted to be extended or retracted relative to the outer section, means to mount said inner section for extension and retraction relative to said outer section, each of said sections including at least three longitudinally extending sides and corner portions joining adjacent sides to define hollow sections, said means to mount said inner section relative to said outer section being situated in said corner portions, said last mentioned means including an elongated corner portion for each section, the corner portion of said outer section having an elongated slot formed therein, plate retainer means extending from the adjacent corner portions of said inner section and engaging through said slot to retain said inner section for extension and retraction relative to said outer section, said corner portion comprising a pair of Z shaped elongated plates lying side by side, one of said plates being reversed with respect to the other of said plates, each of said Z shaped plates having an upper and lower horizontal portion, said Z shaped plates being welded together longitudinally by adjacent upper horizontal portions thereof, with the lower horizontal portions lying spaced apart from one another thereby defining said elongated slot.

2. The invention according to claim 1 in which is included further means spaced and parallel to said first mentioned plate means and engaging said corner portions externally.

3. The invention according to claim 2 in which said corner portions comprise a plate angulated longitudinally to form an apex, the sides of said plate being angulated towards one another at the lower ends thereof whereby the side edges define said elongated slot.

4. The invention according to claim 1 in which said corner portions comprise a plate angulated longitudinally to form an apex, the sides of said plate being angulated towards one another at the lower ends thereof whereby the side edges define said elongated slot.

5. The invention according to claim 1 which includes brace means spanning said corner portions internally thereof, a trolley mounted on at least two of the corner portions of said outer section and engaging the adjacent corner portions of said inner section to reduce the friction between said outer section and said inner section when said sections are extended and retracted relative to one another.

6. The invention according to claim 5 in which said trolley includes a casing, a pair of wheels journalled for rotation in alignment with one another, within said casing, means mounting said casing upon said outer section whereby said wheels extend through said elongated slot and roll upon said brace means, said retainer means being mounted upon said trolley and also engaging through said elongated slot.

7. The invention according to claim 6 which includes means mounting said trolley upon said outer section, said last mentioned means including a shaft secured transversely on said outer section adjacent one end thereof, said casing being freely pivotted on said shaft for independent rocking action for self-aligning engagement with said inner section.

8. A telescopic tower construction comprising in combination a plurality of elongated sections telescopically engaged serially within one another, said sections including an outer section and at least one inner section slidably engaged within said outer section for extension and retraction relative to said outer section, each of said sections being hollow and substantially triangular when viewed in cross section and including a pair of base corner portions and an apical corner portion, each of said base corner portions of said inner section having an elongated slot formed on the underside thereof, brace means spanning said last mentioned corner portions internally substantially parallel to said base of said corner portions, a trolley mounted adjacent each of the base corner portions of said outer section and engaging the adjacent corner portions of said inner section to reduce the friction between said outer section and said inner section when said sections are extended and retracted relative to one another, and a combination anti-friction and cantilever support means between said apical corner portions of said outer and inner sections, said last mentioned means including outer and inner spaced and parallel flanges pivotally secured to the apical corner portion of said inner section and slidably engaging the apical corner portion of said outer section, and a nose wheel journalled for rotation upon the inner end of said inner section and engaging the horizontal track of the apical corner portion of said outer section.

9. The invention according to claim 8 in which said trolley includes a casing, a pair of wheels journalled for rotation in alignment with one another, within said casing, means mounting said casing upon said outer section whereby said wheels extend through said elongated slot and roll upon said brace means, said retainer means being mounted upon said trolley and also engaging through said elongated slot.

10. The invention according to claim 9 which includes means mounting said trolley upon said outer section, said last mentioned means including a shaft secured transversely on said outer section adjacent one end thereof, said casing being freely pivotted on said shaft for independent rocking action for self-aligning engagement with said inner section.

* * * * *